US010574006B2

(12) United States Patent
Storione et al.

(10) Patent No.: US 10,574,006 B2
(45) Date of Patent: Feb. 25, 2020

(54) MULTIPOLAR CONNECTOR WITH CIRCULAR CONTACTS

(71) Applicant: Fischer Connectors Holding SA, Saint-Prex (CH)

(72) Inventors: Savino Storione, Saint-Prex (CH); Nicolas Convert, Saint-Prex (CH); Jean-Marie Buchilly, Saint-Prex (CH)

(73) Assignee: Fischer Connectors Holding SA, Saint-Prex (CH)

( * ) Notice: Subject to any disclaimer, the term of this patent is extended or adjusted under 35 U.S.C. 154(b) by 0 days.

(21) Appl. No.: 15/769,392

(22) PCT Filed: Oct. 13, 2016

(86) PCT No.: PCT/IB2016/056139

§ 371 (c)(1),
(2) Date: Apr. 19, 2018

(87) PCT Pub. No.: WO2017/072620

PCT Pub. Date: May 4, 2017

(65) Prior Publication Data

US 2018/0323556 A1 Nov. 8, 2018

(30) Foreign Application Priority Data

Oct. 27, 2015 (WO) ..... PCT/IB2015/058257
Apr. 21, 2016 (WO) ..... PCT/IB2016/052275

(51) Int. Cl.
*H01R 13/52* (2006.01)
*H01R 24/38* (2011.01)
(Continued)

(52) U.S. Cl.
CPC ..... *H01R 24/38* (2013.01); *H01R 13/24* (2013.01); *H01R 13/2407* (2013.01);
(Continued)

(58) Field of Classification Search
CPC .... H01R 35/04; H01R 39/00; H01R 13/5221; H01R 33/965; H01R 13/5205;
(Continued)

(56) References Cited

U.S. PATENT DOCUMENTS 2,824,290 A 2/1958 Archer et al.
2,892,991 A * 6/1959 Beebee ..... H01R 13/6276 439/319
(Continued)

FOREIGN PATENT DOCUMENTS

CN 104170184 A 11/2014
CN 106299871 A 1/2017
(Continued)

OTHER PUBLICATIONS

International Search Report dated Feb. 8, 2017 for PCT/IB2016/056139 and English translation thereof.
(Continued)

*Primary Examiner* — Abdullah A Riyami
*Assistant Examiner* — Justin M Kratt
(74) *Attorney, Agent, or Firm* — Andrre Roland S.A.; Nikolaus Schibli

(57) ABSTRACT

Connector comprising a base (1) of substantially cylindrical form and a plug (2), connectable to the base in a removable manner to the base (2), in which are disposed a plurality of contacts (3); the base (1) comprising a conducting face (4) on or in which is disposed at least one conducting track (5) forming at least one arc of a circle whose centre (6) is substantially coincident with the centre of the conducting face (4); said track (5) furthermore being disposed in such a way as to permit a mechanical electrical coupling with one of said contacts (3).

10 Claims, 7 Drawing Sheets

(51) Int. Cl.

| | |
|---|---|
| ***H01R 13/627*** | (2006.01) |
| ***H01R 35/04*** | (2006.01) |
| ***H01R 13/24*** | (2006.01) |
| *H01R 13/6582* | (2011.01) |
| *H01R 39/00* | (2006.01) |
| *H01R 33/965* | (2006.01) |

(52) U.S. Cl.
CPC ..... *H01R 13/521* (2013.01); *H01R 13/5219* (2013.01); *H01R 13/6276* (2013.01); *H01R 35/04* (2013.01); *H01R 13/52* (2013.01); *H01R 13/5205* (2013.01); *H01R 13/5221* (2013.01); *H01R 13/6275* (2013.01); *H01R 13/6582* (2013.01); *H01R 33/965* (2013.01); *H01R 39/00* (2013.01)

(58) Field of Classification Search
CPC ..... H01R 13/5219; H01R 13/5202; H01R 13/52; H01R 13/6275; H01R 13/6582
USPC ..... 439/18, 20, 271, 587, 348, 953
See application file for complete search history.

(56) References Cited

U.S. PATENT DOCUMENTS

| | | | | |
|---|---|---|---|---|
| 3,112,975 | A | 12/1963 | Hamel | |
| 3,237,147 | A | 2/1966 | Elliott et al. | |
| 3,521,216 | A | 7/1970 | Tolegian | |
| 4,601,528 | A | 7/1986 | Spier | |
| 5,114,361 | A | 5/1992 | Houtteman | |
| 5,413,508 | A | 5/1995 | Obara | |
| 5,509,821 | A | 4/1996 | Small et al. | |
| 5,704,792 | A | 1/1998 | Sobhani | |
| 5,865,638 | A | 2/1999 | Trafton | |
| 6,243,870 | B1 | 6/2001 | Graber | |
| 6,331,117 | B1 | 12/2001 | Brundage | |
| 6,395,985 | B1 | 5/2002 | Djeddah | |
| 6,716,048 | B2 * | 4/2004 | Collin | H01R 13/6276 439/317 |
| 6,895,261 | B1 | 5/2005 | Palamides | |
| 7,151,455 | B2 | 12/2006 | Lindsay et al. | |
| 7,462,035 | B2 | 12/2008 | Lee et al. | |
| 7,658,612 | B2 | 2/2010 | Lee et al. | |
| 8,490,525 | B2 | 7/2013 | Wilson et al. | |
| 8,961,191 | B2 | 2/2015 | Hanshew | |
| 9,300,083 | B2 * | 3/2016 | Bosscher | H01R 13/665 |
| 9,391,390 | B2 | 7/2016 | Endo et al. | |
| 9,847,609 | B2 | 12/2017 | Planard-Luong | |
| 2005/0148241 | A1 | 7/2005 | Kohen | |
| 2006/0128169 | A1 | 6/2006 | Marmaropoulos et al. | |
| 2007/0026695 | A1 | 2/2007 | Lee et al. | |
| 2010/0075512 | A1 | 3/2010 | Lai | |
| 2010/0100997 | A1 | 4/2010 | Lee et al. | |
| 2012/0028489 | A1 | 2/2012 | Gramsamer et al. | |
| 2014/0273543 | A1 * | 9/2014 | Hanshew | H01R 39/64 439/18 |
| 2016/0211627 | A1 * | 7/2016 | Planard-Luong | H01R 13/521 |
| 2018/0054017 | A1 | 2/2018 | Watkins et al. | |
| 2019/0067859 | A1 | 2/2019 | Sugiura | |

FOREIGN PATENT DOCUMENTS

| | | | |
|---|---|---|---|
| DE | 3722196 | A1 | 1/1989 |
| DE | 4135679 | C2 | 10/2001 |
| EP | 2144336 | B1 | 3/2011 |
| EP | 2461429 | A1 | 6/2012 |
| EP | 2533374 | A1 | 12/2012 |
| FR | 1354923 | | 3/1964 |
| FR | 2456406 | A1 | 12/1980 |
| FR | 2690569 | | 10/1993 |
| FR | 3010245 | A1 | 3/2015 |
| WO | WO 97/02630 | A1 | 1/1997 |
| WO | WO1997/002630 | | 1/1997 |
| WO | WO 2015/028953 | | 3/2015 |

OTHER PUBLICATIONS

Written Opinion of the International Search Authority dated Feb. 8, 2017 for PCT/IB2016/056139.
Search Report of the Intellectual Property Office of Singapore ("IPOS") for Application No. 11201803171R dated Dec. 4, 2018.
Written Opinion of the Intellectual Property Office of Singapore ("IPOS") for Application No. 11201803171R dated Dec. 5, 2018.
Chinese Patent Application 2016800633324.7 Office Action dated Apr. 1, 2019.
European Patent Application EP16798557.1 Office Action dated Apr. 4, 2019.
International Search Report dated Jun. 4, 2019 for related case with the Application No. PCT/IB2019/052818.
International Search Report dated Jun. 6, 2019 for related case with the Application PCT/IB2019/052822.

* cited by examiner

MULTIPOLAR CONNECTOR WITH CIRCULAR CONTACTS

CROSS-REFERENCE TO RELATED APPLICATIONS

The present application is a United States national stage application of International patent application PCT/IB2016/056139 filed on Oct. 13, 2016 designating the United States, and claims foreign priority to International patent application PCT/IB2016/052275 filed on Apr. 21, 2016, and to International patent application PCT/IB2015/058257 filed on Oct. 27, 2015, the contents of all three documents being herewith incorporated by reference in their entirety.

FIELD OF THE INVENTION

The present invention relates to connectors, in particular electrical connectors.

RELATED ART

In most cases, the use of a multipole connector requires the two main components (e.g. one component containing male contacts and one component with female contacts) to be fixed to one another according to a specific angular orientation.

The fact of having to align one component relative to the other, prior to connection, constitutes a nuisance. There is therefore a need to be able to eliminate this nuisance.

SUMMARY

The invention proper consists of a connector comprising a socket of substantially cylindrical form and a plug, that can be removably connected to the socket, in which there are arranged a plurality of contacts. The socket comprises a conductive face in the form of a disk on or in which there is arranged at least one conductive track forming at least one circular arc whose center substantially coincides with the center of the conductive face, said track being also arranged so as to allow a mechanical electrical coupling with one of said contacts.

In the connector according to the invention, the socket and the plug constitute the two main components which form the connector.

In the particular configuration which comprises only a single circular track, the center of the face of the socket is a conductive disk, which is arranged so as to allow an electrical coupling with a contact of the plug arranged at the center thereof.

Preferably, the connector comprises at least two circular conductive tracks which are arranged concentrically.

Advantageously, each contact of the plug is mounted to be axially mobile, independently of the other contacts, in order to ensure a permanent mechanical contact with the conductive tracks of the socket.

A mechanism can be provided to exert a return force on each contact.

According to a variant of the invention, the contacts are arranged through a flexible membrane, for example made of rubber, which is preferably seal-tight.

The plug, overall, can be oriented in a single direction. Alternatively, it can be bent.

The plug can be connected to be free to rotate about the socket, or according to a limited number of angular orientations.

The invention will be better understood from the following description which in particular contains a few illustrated examples.

DETAILED DESCRIPTION OF THE SEVERAL EMBODIMENTS

Figure 1:
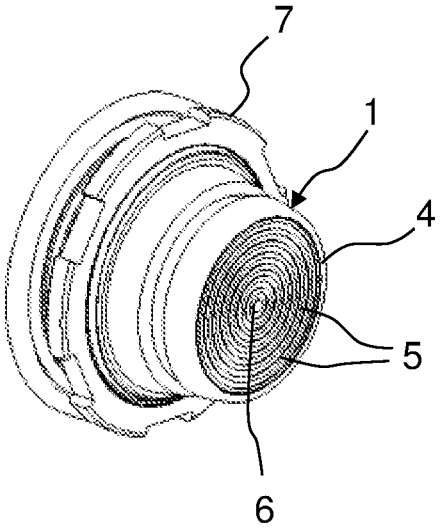
FIG. 1 represents a variant of the invention with a socket designed for a free orientation of the plug.

1. Socket
2. Plug
3. Contact
4. Conductive face
5. Conductive track
6. Center of the conductive face
7. Nut
8. Contact
9. Membrane
10. Output
11. Spring ring
12. Ball
13. Circular groove
14. Ball housing According to the embodiment illustrated in the present document, the connector comprises seven contacts.

It goes without saying that the invention is not limited to this configuration. It also covers all the connectors comprising at least two contacts.

Likewise, the dimensions of the connector according to the invention can be any dimensions.

The connector according to the invention has the particular feature of not requiring prior orientation of the plug 2 (e.g. a wired element) relative to the socket 1 (e.g. a unit housing element). This advantage results from the cylindrical/circular geometry of the socket and of its conductive face 4 (see for example FIG. 1). Once connected, the relative rotation between the socket 1 and the plug 2 can be free or blocked via a bistable-type system, for example a locking by lateral pressure and unlocking by axial pressure).

Figure 2:
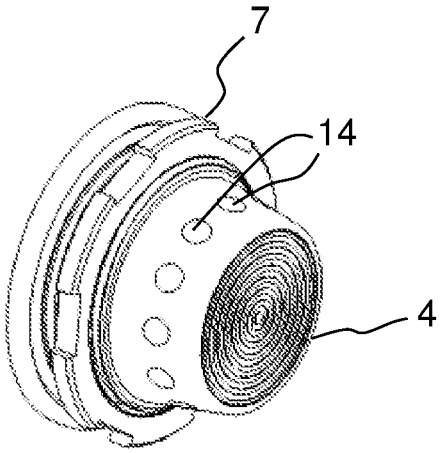
FIG. 2 represents another variant of the invention with a socket designed for limited angular orientations of the plug.

An orientation can nevertheless be given and limit the plugging-in possibilities to a finite number of different angular positions (e.g. four positions separated by 90° or 12 positions separated by 30°) as described in FIG. 2.

The socket 1 is composed of a body that can be fixed onto an external device via a fixing element such as a nut 7 (FIG. 1) or rivets or any other suitable means making it possible to durably fix these two elements (e.g.: socket sewn onto a fabric/clothing item).

Figure 3:
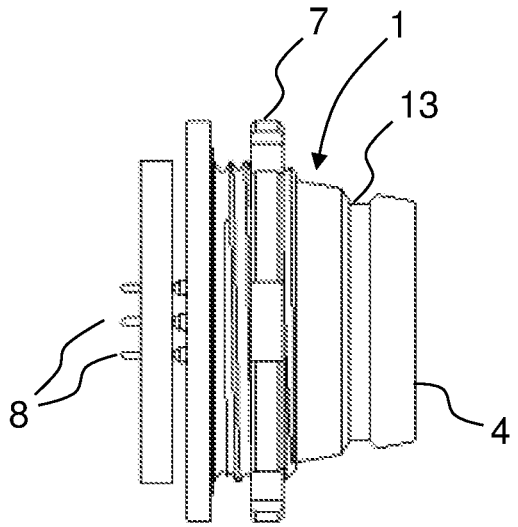
FIG. 3 represents a side view of the socket.

The socket 1 can be connected to the device via metallic contacts 8 which interconnect directly with the device (that can be a fabric incorporating conductive parts incorporated or not in the fabric) or through an electrical circuit (PCB, flex, etc.) welded to the socket and interfacing with the device (FIG. 3).

Figure 4:
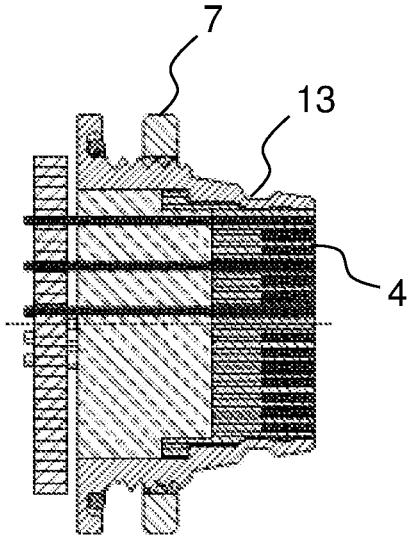
FIG. 4 represents a cross-sectional view of a socket.

The plug 2 is composed of electrically conductive parts separated by electrically insulating parts. It can be composed of any type of assembly of parts making it possible to ensure the function of signal transmission and of electrical insulation (FIG. 1 and FIG. 4). The plug 2 and the socket 1 are preferably "cleanable" in as much as it is easy to access the surface in order to eliminate dirt/deposits/particles without a specific cleaning tool.

Advantageously, the plug 2 connects to and disconnects from the socket 1 by a single hand.

Figure 5:
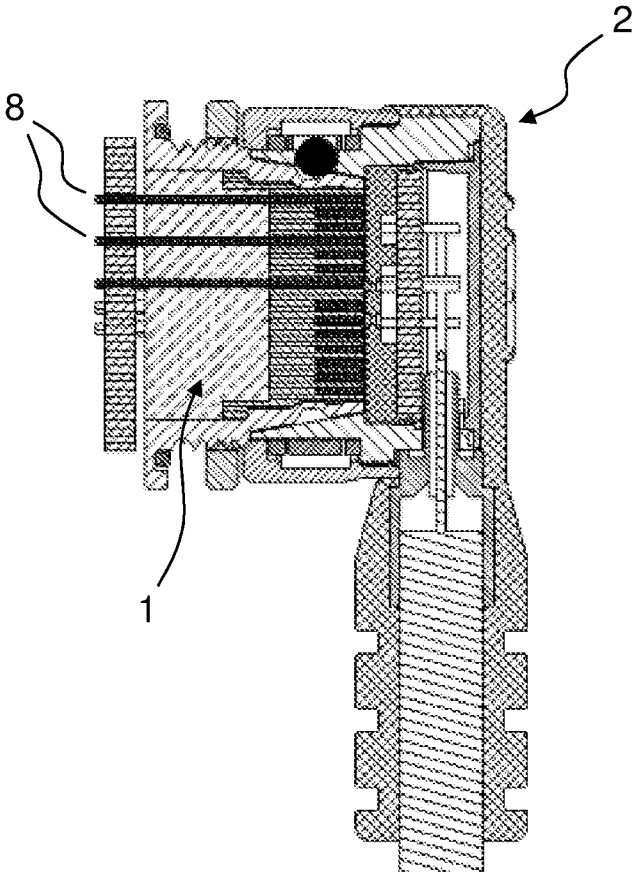
FIG. 5 represents a plug (bent)-socket pair connected together.

The connection/disconnection can be performed by simple pressure/pulling force on the plug 2 (variant without locking) (FIG. 5). According to another variant, the connector comprises a locking and a lateral pressure on the two sides (or any other deliberate action) is necessary in order to free the locking mechanism.

Preferably, the plug 2 should exhibit a certain elasticity in order to guarantee the electrical contact with the socket 1. To this end, each contact 3 can be mounted to be axially mobile independently of the other contacts 3 in order to guarantee that each contact 3 is pressed onto the corresponding track 5 of the socket 1. Advantageously, the contacts 3 pass through a flexible membrane 9, obtained for example by overmolding a rubber over the contacts 3 or any other means in order to constitute a subassembly allowing the individual mobility of the contacts 3 relative to one another (FIG. 5).

The membrane 9 also makes it possible to guarantee the seal-tightness of the assembly.

An elastic element (not represented in the illustrations), inducing a return mechanism toward the socket 1, makes it possible to exert an individual pressure on each contact 3 in order to guarantee the electrical continuity on each contact 3. It should be noted that the membrane 9 can exert this elastic element function.

Figure 6:
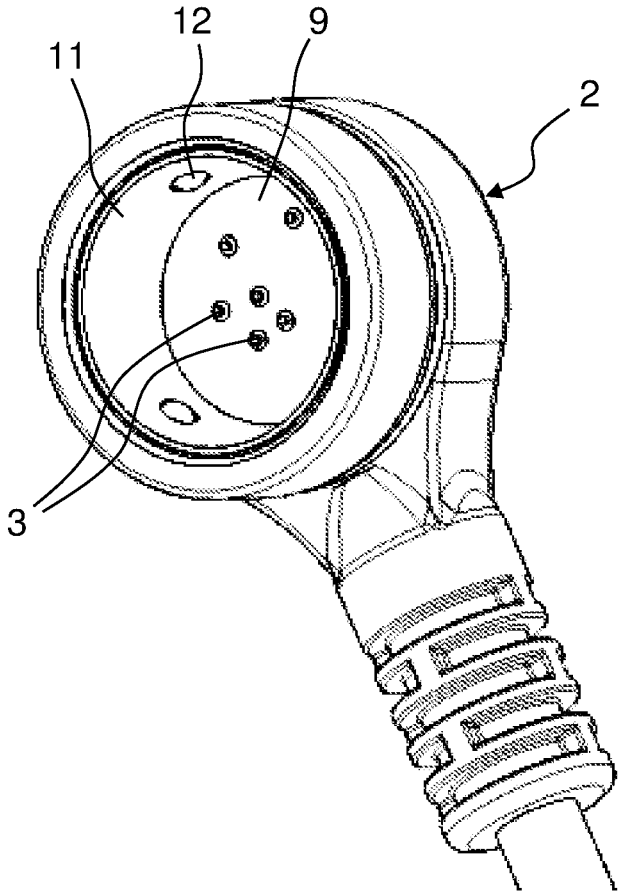
FIG. 6 represents another view of a bent plug.

The quasi-smooth surface of the membrane 9 and of the contacts 3 makes it possible to also guarantee a perfect "cleanability", similar to that of the socket 1 (FIG. 6).

Figure 7:
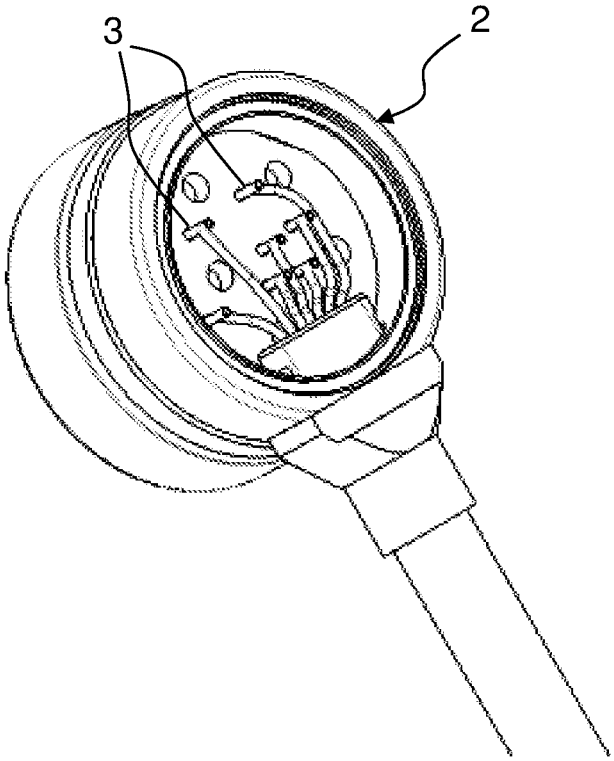
FIG. 7 shows the wiring of a plug.

The wires of the cables or any other link means, e.g. PCB (not illustrated), are connected (e.g. horizontally welded) onto the rear face of each contact 3 in order to guarantee the electrical link while limiting the bulk. A cap covers the assembly in order to mechanically protect the system and render it seal-tight (FIG. 7).

According to another variant (not illustrated) of the invention, the concentric tracks form circular grooves in the face of the socket.

Figure 8:
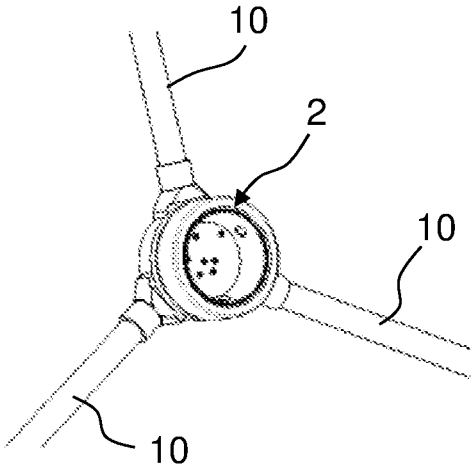
FIG. 8 represents a plug comprising several outputs.

The number of outputs 10 of the plug 2 and of the socket 1 can be multiple (FIG. 8).

Figure 9:
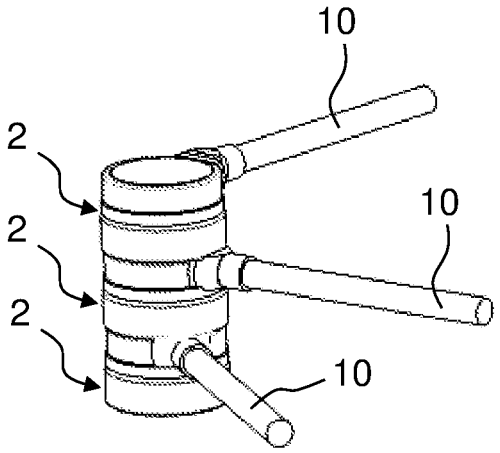
FIG. 9 represents a stack of plugs/sockets.

The plug 2 can include a "socket" part in order to allow a stacking of several plugs/sockets (FIG. 9).

The locking and/or the acknowledgement of plugging-in of the connector can be produced by means of a spring ring 11 exhibiting a certain elasticity, the ring 11 bearing on balls 12 which have themselves come to be housed in a groove 13 formed on the socket (FIGS. 1 and 3).

Figure 10:
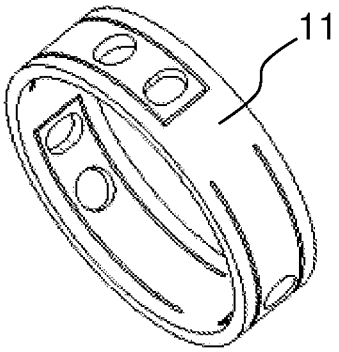
FIG. 10 represents a spring ring.
Figure 11:
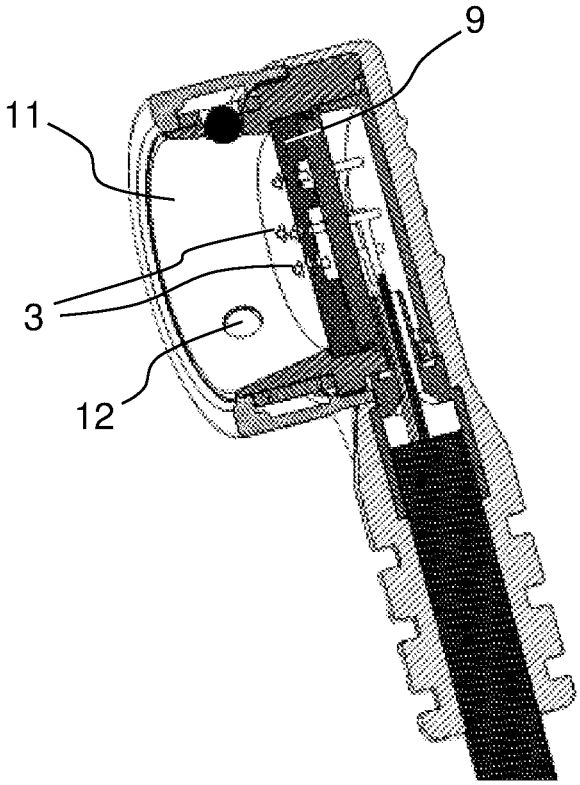
FIG. 11 represents the incorporation of a spring ring in a plug.

A possible illustration of the spring ring 11 is illustrated in FIG. 10 and its incorporation in the plug 2 is illustrated in FIG. 11.

The position of the ball housings 14 (FIG. 2) can be multiple and offer several locking points in order to avoid the rotation once plugged in.

The invention claimed is:

1. A removable connector comprising:

a socket of substantially cylindrical form having a rotation axis, the socket including a face having a plurality of conductive tracks forming circular arcs, each arc having a center that substantially coincides with the rotation axis of the socket;

a plug configured to be removably connected to the socket, the plug including, a plurality of contacts, at least one of the plurality of contacts configured for mechanical electrical coupling with a corresponding one of the plurality of conductive tracks, each one of the plurality of contacts configured to be axially mobile independently of the other contacts, and a flexible membrane that is traversed by the plurality of contacts, the flexible membrane being seal-tight and configured to exert an individual pressure on each one of the plurality of contacts as a return mechanism towards the socket; and a connection mechanism permitting the removable connection between the plug and the socket, the connection mechanism including a spring ring, balls, and a circular groove, the spring ring configured to urge the balls into the circular groove in a mated position to allow for a rotation of the plug relative to the socket, wherein the spring ring and the balls are arranged on either the plug or the socket, and the circular groove is arranged on either the socket or the plug, respectively.

2. The connector as claimed in claim 1, wherein at least two of the plurality of conductive tracks are arranged concentrically.

3. The connector as claimed in claim 1, wherein the plug has a bent shape.

4. The connector as claimed in claim 1, wherein the plurality of contacts are distributed asymmetrically on the face.

5. The connector as claimed in claim 1, wherein the plug comprises a socket element configured to allow a stacking of several plugs and/or sockets.

6. The connector as claimed in claim 1, wherein the socket is fixed to an external device by a fixing element and is connected to the device by contacts interconnecting directly with the device or through an electrical circuit electrically connected to the socket and interfacing with the device.

7. The connector as claimed in claim 1, wherein the circular groove is arranged around the socket, and the spring ring and the balls are arranged around the plug.

8. The connector as claimed in claim 1, wherein the plug includes a cylindrically-shaped opening for accommodating the socket, the balls arranged within an inner cylindrical side wall of the cylindrically-shaped opening, the flexible membrane forming a bottom of the cylindrically-shaped opening.

9. The connector as claimed in claim 8, wherein the flexible membrane has a disk-like element that is traversed by the plurality of contacts, the cylindrically-shaped opening is tapered towards the bottom, such that a diameter of the cylindrically-shaped opening at the bottom is smaller than a diameter of the disk-like element, the disk-like element held by the side wall of the cylindrically-shaped opening.

10. The connector as claimed in claim 1, wherein the spring ring includes a plurality of curved leaf springs that urge against the respective balls.

* * * * *